US005321920A

United States Patent [19]

Sichel

[11] Patent Number: 5,321,920

[45] Date of Patent: Jun. 21, 1994

[54] ROOF GUTTER SCREEN

[76] Inventor: Gerald M. S. Sichel, 57 Pacific Highway, Ourimbah, Australia

[21] Appl. No.: 104,991

[22] Filed: Aug. 10, 1993

Related U.S. Application Data

[63] Continuation-in-part of Ser. No. 889,815, May 29, 1992, Pat. No. 5,257,482.

[30] Foreign Application Priority Data

May 11, 1993 [AU] Australia ..... 38506/93

[51] Int. Cl.[5] ..... E04D 13/00

[52] U.S. Cl. ..... 52/12; 52/94; 52/660

[58] Field of Search ..... 52/11, 12, 94, 660

[56] References Cited

U.S. PATENT DOCUMENTS

| | | | |
|---|---|---|---|
| 546,042 | 9/1895 | Van Horn | 52/12 |
| 2,674,961 | 4/1954 | Lake | 52/12 |
| 3,351,206 | 11/1967 | Wennestrom | 52/12 X |
| 3,436,878 | 4/1969 | Singer | 52/12 |
| 4,646,488 | 3/1987 | Burns | 52/94 |
| 4,745,710 | 5/1988 | Davis | 52/12 |

FOREIGN PATENT DOCUMENTS

| | | | |
|---|---|---|---|
| 318698 | 12/1969 | Sweden | 52/12 |

*Primary Examiner*—Carl D. Friedman
*Assistant Examiner*—Beth A. Aubrey
*Attorney, Agent, or Firm*—Tilton, Fallon, Lungmus

[57] ABSTRACT

An improved gutter screen, and the combination of such a screen with a roof and gutter upon which it is mounted, in which the screen is of flexible, open-mesh construction, having spaced, flow-directing ribs extending in directions parallel with the slope of the roof and transverse flow-interrupting bars extending between the ribs. Together the flow-directing ribs and the flow-interrupting bars define a multiplicity of small, generally rectangular apertures, with the ribs being of a height substantially greater than that of the bars. The screen includes on its underside an underrib, parallel to the bars and the length of the gutter, to break up the surface tension of water flowing along the underside and direct the water into the gutter.

10 Claims, 2 Drawing Sheets

13
10
20
5
21
22
20b
3
3
5
11
15
20a
20c
14a
14
12

22
20a
21
14a
14

20
4
25
4
24
l
25
w
26

31

25
32
24
33
20
25
26

25
W
24
20
H
h
26
30

Fig. 6
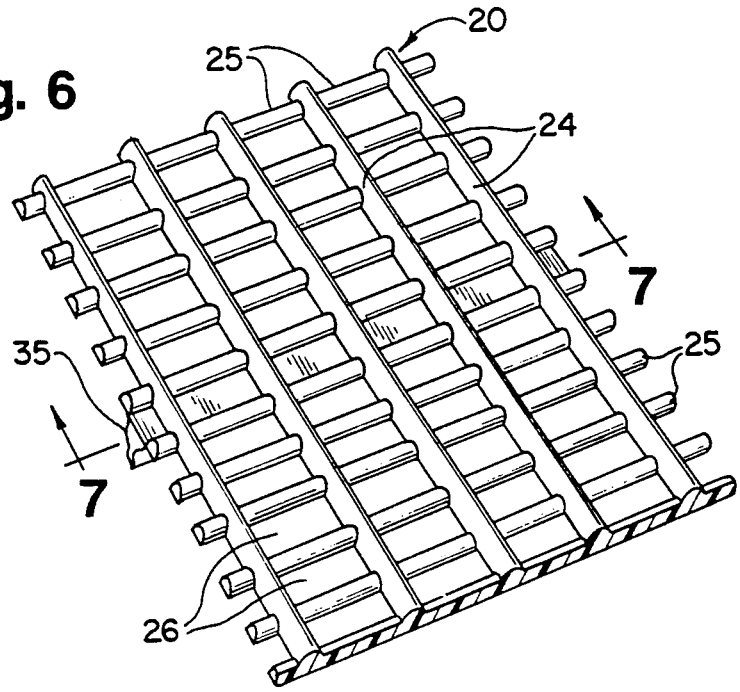
Fig. 7
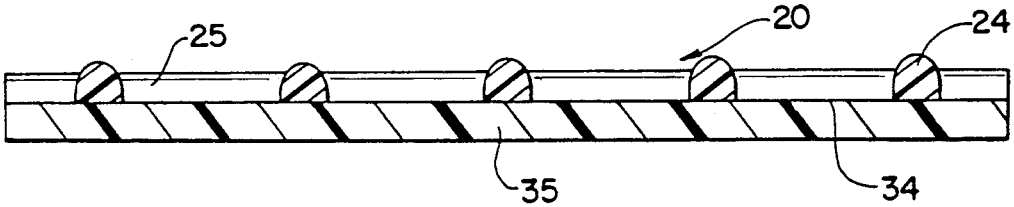
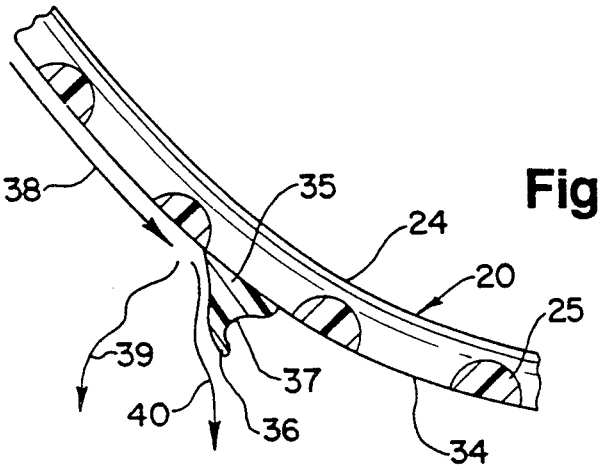
Fig. 8

ROOF GUTTER SCREEN

BACKGROUND AND SUMMARY

This application is a continuation-in-part of application Ser. No. 889,815, filed May 29, 1992 now U.S. Pat. No. 5,257,482.

Various types of screening devices for rain gutters have been previously known but have been largely unsuccessful because of various shortcomings. In general, such devices have been provided with relatively large openings to increase the possibilities that water flowing from a roof will fall through the screen into a gutter rather than overflowing the screen as a fluid sheet during a heavy downpour. However, screens with openings large enough to reduce the possibilities of such overflow also tend to be large enough to snare leaves and other debris, thereby negating or reducing the usefulness of the screens and, because of the additional structure, increasing the problems of gutter cleaning and maintenance that such systems are intended to avoid. In an effort to overcome some of these problems, hinged gutter guards have been devised as disclosed, for example, in U.S. Pat. Nos. 2,072,415, 4,032,456, 2,841,100, 4,351,134 and 3,420,378. Such systems only serve to reduce, not eliminate, the inconveniences of gutter cleaning and, because of their complexity, are usually more expensive to purchase, install, and maintain than simpler arrangements. Other patents illustrating the state of the art are U.S. Pat. Nos. 2,271,081, 4,769,957, 4,866,890, 3,053,393 and published United Kingdom application GB 2,218,828A.

An important aspect of this invention lies in the discovery that a highly effective and relatively inexpensive gutter screening system may be achieved if the apertures of a screen are relatively small and are of rectangular shape, and if the ribs and bars defining such apertures are dimensioned and arranged, first, to direct or channel the flow of water along the screen in the direction of roof slope and, second, to interrupt the directed flow, breaking surface tension and deflecting the water through the screen apertures and into the gutter. Because of the small size of such apertures, and because the flow-directing ribs protrude well above the transverse flow-interrupting bars of the screen, leaves and twigs are unlikely to become entrapped or restrained. At the same time, the construction and arrangement of flow-directing ribs and flow-interrupting bars promotes the flow of rain water into a gutter despite the relatively small dimensions of the apertures.

The screen is mounted so that its upper portion assumes the same slope as that of the roof. The remainder of the screen overlying the gutter may continue downwardly following generally the same slope, although it has been found that in most cases the standard mounting of a gutter results in a gentle curvature of that portion of the screen overlying the gutter opening with the outer edge of the screen assuming a generally horizontal condition where it is supported upon the outer edge or flange of the gutter. The tensioned condition of the screen caused by such curvature tends to keep its outer edge portion in forceful contact with the gutter's outer flange, although it is preferred that the outer portion of the screen be securely clamped in position by suitable attachment means. Such attachment means may take the form of an L-shaped clamping strip secured by nylon press studs or rivets to the outer flange of the gutter.

The rectangular apertures or openings of the screen are elongated in directions parallel with a gutter with each aperture having an area within the general range of 4 to 30 square millimeters. A preferred range is 5 to 20 square millimeters, with particularly effective results being obtained with areas of about 10 square millimeters. The optional dimensions of each aperture are believed to be approximately 5 millimeters in length and 2 millimeters in width, although variations (with decreasing effectiveness) may be achieved with lengths falling within the general range of 4 to 10 millimeters and widths of 1 to 3 millimeters. The undersurfaces of the flow-directing ribs and flow-interrupting bars are generally coplanar but the height of the ribs should be approximately 40 to 100 percent greater than the height of the bars.

The coplanar undersurfaces of the ribs and bars result in the screen having a planar underside that, although preferable over a non-planar underside for manufacturing, installation, and other reasons, can cause water to adhere to the underside after passing through the apertures due to surface tension. This can result in a build-up of water on the underside which may impede the water's flow through the apertures and into the gutter. This build-up of water can also cause water to accumulate at the edge of the screen and possibly result in water flowing over the gutter's edge. A further important aspect of this invention therefore lies in providing on the underside of the screen an underrib, parallel to the flow-interrupting bars and the length of the gutter, to break up the surface tension of the water flowing along the underside and direct the water into the gutter. Preferably, the underrib is generally positioned over the center of the gutter and it includes a tapered portion that is directed towards a lower portion of the screen and causes the water to drop from the underrib into the gutter.

Additional features, objects, and advantages of the invention will become apparent from the specification and drawings.

DRAWINGS

FIG. 6 is a perspective view of a portion of the screen in unflexed or planar condition with an underrib positioned on the underside of the screen.

FIG. 7 is an enlarged cross sectional view along line 7—7 of FIG. 6.

FIG. 8 is a greatly enlarged sectional view along line 3—3 of FIG. 1 but with the addition of an underrib on the underside of the screen.

DETAILED DESCRIPTION OF PREFERRED EMBODIMENT

Figure 1:
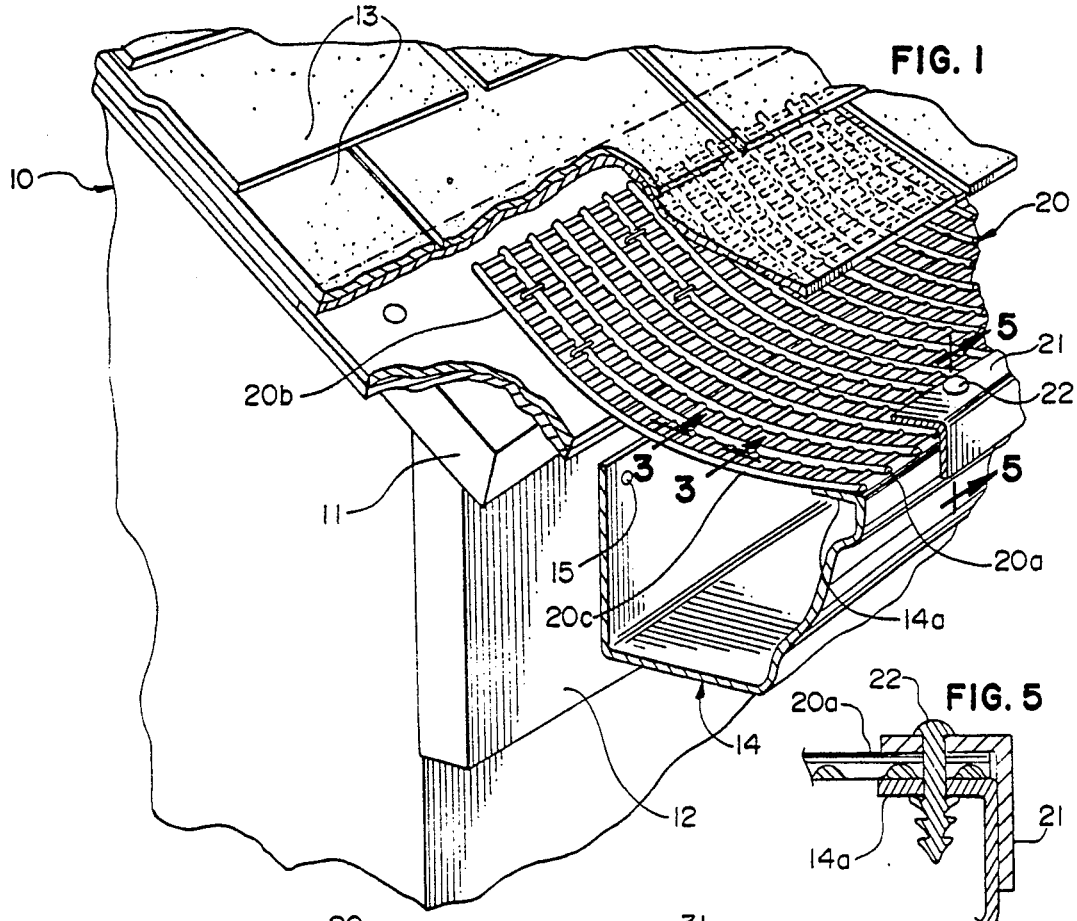
FIG. 1 is a perspective view, partly in section, showing a rain gutter screening system embodying the invention.

Referring to the drawings, the numeral 10 generally designates a building structure having a sloping roof 11, fascia or wall panel 12, and roofing shingles or tiles 13. A standard rain gutter 14 is secured by nails or other suitable fastening means to the vertical surface of fascia panel 12 directly below the overhanging lower edge of the sloping roof. While the gutter depicted in the drawings has the characteristic configuration of colonial-style gutters in common use, it will be understood that gutters of other shapes may be used with the screening system of this invention.

Screen 20 is an open-mesh strip that may extend the length of gutter 14 or, for convenience of installation, may be composed of a plurality of shorter segments that are arranged end-to-end to run the full extent of the gutter. The width of the strip substantially exceeds the width of the gutter so that when the lower edge portion 20*a* of the strip is secured to the outer edge or flange 14*a* of the gutter, the strip's upper portion 20*b* extends upwardly beneath the lower course of shingles, following the same slope as that of roof 10. While the arrangement depicted in FIG. 1 is preferred, it is to be understood that, if desired, the upper portion 20*b* of the strip may be secured to the exposed surfaces of the shingles rather than inserted beneath the lower course (or the lower two courses) as shown. It should also be understood that lower edge portion 20*a* may be provided with a selvedge or unperforated portion (not shown) to reinforce the edge and facilitate attachment to flange 14*a* by a pop-rivot or the like.

Gutter 14 is shown to be mounted only slightly below the overhanging lower edge of roof 11 with the result that a gradual curvature is imposed on the intermediate or transitional portion 20*c* of the screen that overlies the trough of the gutter. Such curvature is believed particularly desirable although it will be evident that in some instances a lower mounting of the gutter will cause the screen to continue downwardly over the gutter along substantially the same slope as that of the roof rather than curving into a more horizontal condition along its free outer edge portion 20*a* as shown.

Figure 5:
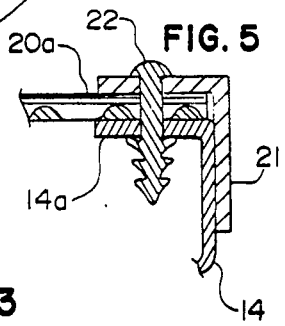
FIG. 5 is an enlarged cross sectional view along line 5—5 of FIG. 1.

The screen is preferably formed of a flexible but fairly stiff polymeric material such as high-density ultraviolet stabilized polyethylene. Other polymeric materials having similar properties may be used as well as certain metals such as, for example, aluminum. Since the open-mesh strip assumes a generally planar condition in an unflexed state, the lower edge portion 20*a* forcibly engages the flange 14*a* of the gutter because of the tension imposed by the enforced curvature. Additional security of attachment as well as enhanced appearance may be achieved by securing an L-shaped clamping strip or trim strip 21 to flange 14*a* as illustrated in FIG. 5. Nylon press studs or rivets 22 may be inserted through aligned openings in the strip 21 and gutter flange 14*a* to secure the strip with the lower edge portion 20*a* of the screen securely clamped in place.

Figure 2:
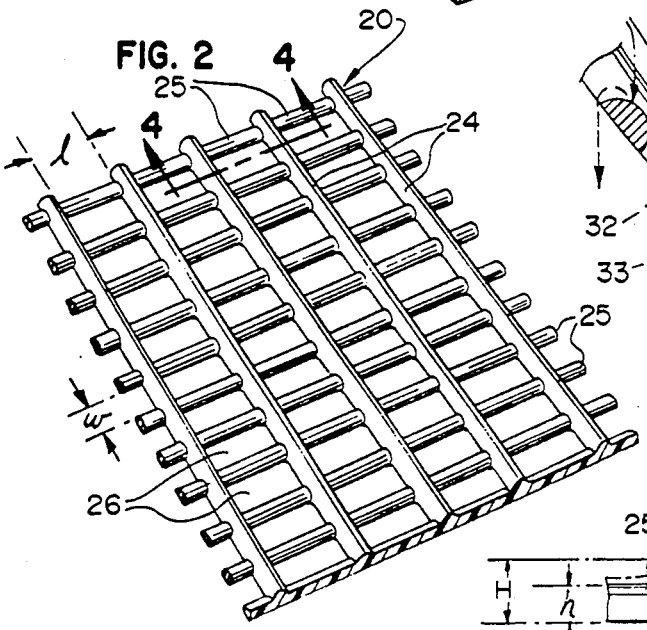
FIG. 2 is a perspective view of a portion of the screen in unflexed or planar condition.
Figure 3:
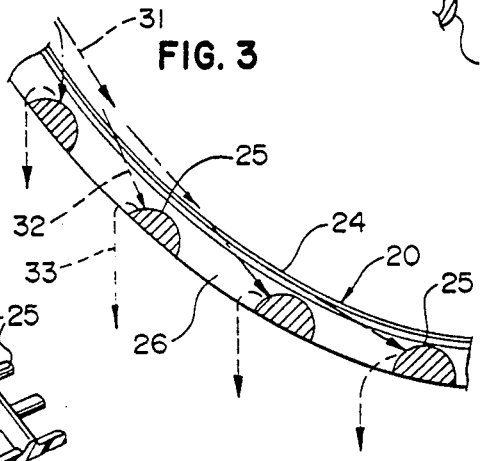
FIG. 3 is a greatly enlarged sectional view along line 3—3 of FIG. 1.
Figure 4:
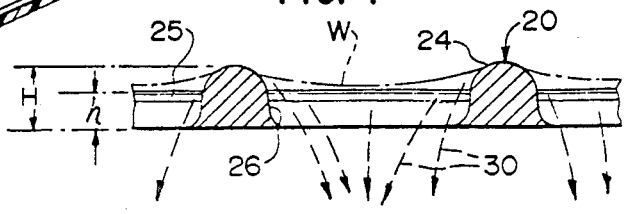
FIG. 4 is an enlarged cross sectional view along line 4—4 of FIG. 2.

Referring to FIGS. 2-4, it will be observed that the open-mesh screen 20 is composed of an arrangement of spaced, parallel, flow-directing ribs 24 which extend in the general direction of the slope of the roof and transverse flow-interrupting bars 25 which connect the ribs and extend horizontally. The ribs and bars are dimensioned and arranged to define a multiplicity of rectangular apertures 26 with each aperture being elongated in a horizontal direction as shown. It is important that each aperture has an area falling within the general range of 4 to 30 square millimeters, or a preferred range of 5 to 20 square millimeters. Particularly effective results are obtained if each aperture has an area of approximately 10 square millimeters. Such relatively small apertures prevent the passage or snaring of leaves, twigs, and other debris but, because of the structural relationships hereinafter described, water flowing from roof 10 is nevertheless directed through such apertures into gutter 14.

Each rectangular aperture has a length (l) falling within the general range of 4 to 10 millimeters and a width (w) within the range of about 1 to 3 millimeters (FIG. 2). Most desirably, such dimensions are about 5 and 2 millimeters, respectively. It will be noted that the flow-directing ribs 24 and the flow-interrupting bars 25, although coplanar along their undersurfaces, are of substantially different height. Specifically, the height H of the ribs 24 is 40 to 100 percent greater than the height h of bars 25 (FIG. 4). The thickness T of each rib, measured along the plane of the screen 20, should fall within the general range of 2.5 to 3.5 millimeters (preferably 2.75 to 3.0) and the thickness t of the bars should be in the general range of 1.5 to 2.5 millimeters (preferably 1.75 to 2.0).

Such relationships result in a structure that directs rain water from roof 10 along, and particularly between, parallel ribs 24. It is believed that because of the height differential between ribs 24 and bars 25, the surface tension of the water, which might otherwise cause the water to flow as a sheet over the top of the screen, is disrupted. In FIG. 4, the surface of the water is schematically depicted by phantom line W. As the surface of the moving water drops between the upper limits of ribs 24, the water impinges on transverse bars 25 and the bars disrupt the flow as represented by arrows 30 (FIG. 4). Such action is also depicted in FIG. 3 where arrows 31 represent the general direction of flow, arrows 32 indicate the lower meniscus (or menisci), and arrows 33 indicate the water redirected by transverse bars 25 and falling downwardly into the trough of the gutter.

Ribs 24, in addition to their flow-directing function, also serve as protective shoulders or rails that tend to deflect twigs, stems, leaves, and other debris and prevent them from contacting bars 25. To the extent that such ribs provide slide surfaces that follow the direction of slope and protrude well above the transverse bars, they prevent debris from being impeded or ensnared by the bars or from entering apertures 26.

Referring to FIGS. 6, 7 and 8, screen 20 is shown having a generally planar underside 34 formed by the coplanar undersurfaces of ribs 24 and bars 25. An underrib 35 extends in a perpendicular direction from underside 34 and projects into the gutter once installed. The longitudinal length of underrib 35 runs generally parallel to bars 25 and the length of the gutter when installed. Preferably, underrib 35 is positioned on underside 34 such that when screen 20 is installed over a gutter, underrib 35 will be positioned generally medially of the gutter. Positioning underrib 34 on intermediate portion 20*c* of screen 20 in the manufacturing or molding process will generally ensure that underrib 35 is positioned over a central portion of the gutter once installed. It is believed that underrib 35 works best to break up the surface tension of the water running along underside 34 if underrib 35 extends a distance d of approximately 4–5 millimeters from underside 34.

In FIG. 8, underrib 35 is shown having a tapered portion 36 that extends in a direction towards the edge or lower portion 20*a* of screen 20 (FIG. 1). Preferably, a recess 37 is located adjacent tapered portion 36 on the side of underrib 35 to facilitate the flow of water into the gutter. Such a construction results in underrib 35 disrupting a flow of water 38 that may adhere to underside 34 due to surface tension. It is believed that some of the water impinging upon underrib 35 will be deflected into the gutter as shown by arrow 39 while some of the water may continue to flow along underrib 35 as shown by arrow 40. It is further believed that the pointed shape of tapered portion 36 and the positioning of recess 37 will prevent the water from further contact with underside 34 and the water will accumulate on tapered portion 36 until the weight of the water exceeds the surface tension between the water and the underrib, at which point the water will drop or flow into the gutter.

While in the foregoing I have disclosed an embodiment of the invention in considerable detail for purposes of illustration, it will be understood by those skilled in the art that many of these details may be varied without departing from the spirit and scope of the invention.

I claim:

1. A flow-directing gutter screen formed of flexible material of open-mesh construction, said screen having a multiplicity of spaced, parallel, flow-directing ribs arranged to extend in directions parallel with the slope of a roof upon which said screen is to be mounted and transverse flow-interrupting bars extending between said ribs and defining a multiplicity of generally rectangular apertures, said ribs and bars having generally coplanar undersurfaces that form a generally planar underside of said screen, and an underrib positioned on said underside, parallel to said bars, and extending from said underside in a direction generally perpendicular to said underside.

2. The screen of claim 1 wherein said underrib is positioned on said underside such that when said screen is mounted over a gutter, said underrib will be positioned generally medially of said gutter.

3. The screen of claim 1 in which said underrib extends from said underside a distance of approximately 4–5 millimeters.

4. The screen of claim 1 in which said underrib includes a tapered portion sloped towards a lower edge portion of said screen.

5. The screen of claim 4 in which said underrib further includes a recess adjacent said tapered portion.

6. In combination with a building structure having a sloping roof and a gutter extending along an edge of said roof, an open-mesh gutter screen having an upper portion secured to the roof and following the slope thereof, an intermediate portion overlying said gutter for allowing the flow of water into said gutter while restraining the deposit of debris therein, and a lower edge portion attached to an outer flange of said gutter, wherein the improvement comprises said screen being flexible and having a series of spaced, parallel, flow-directing ribs extending in the direction of the slope of said roof and transverse flow-interrupting bars extending between said ribs, said ribs and said bars defining a multiplicity of generally rectangular apertures, said ribs and said bars also having undersurfaces which are generally coplanar and form a generally planar underside of said screen, and said underside including an underrib parallel to said bars and extending from said underside in a direction generally perpendicular to said underside.

7. The combination of claim 6 in which said underrib is positioned on said intermediate portion of said screen.

8. The combination of claim 6 in which said underrib extends from said underside a distance of approximately 4–5 millimeters.

9. The combination of claim 6 in which said underrib includes a tapered portion sloped towards said lower edge portion of said screen.

10. The combination of claim 9 in which said underrib includes a recess adjacent said tapered portion.

* * * * *